United States Patent [19]

Shaw

[11] Patent Number: 4,658,578

[45] Date of Patent: Apr. 21, 1987

[54] IGNITING ROCKET PROPELLANTS UNDER VACUUM CONDITIONS

[75] Inventor: Graham C. Shaw, Garland, Utah

[73] Assignee: Morton Thiokol Inc., Chicago, Ill.

[21] Appl. No.: 714,351

[22] Filed: Mar. 21, 1984

Related U.S. Application Data

[63] Continuation of Ser. No. 569,543, Jan. 10, 1984, abandoned, which is a continuation of Ser. No. 463,355, Feb. 2, 1983, abandoned.

[51] Int. Cl.[4] ..... C06B 45/10; F02K 9/08

[52] U.S. Cl. ..... 60/205; 60/219; 60/256; 149/19.4; 149/19.9; 149/20

[58] Field of Search ..... 149/19.4, 19.9, 20; 60/205, 219, 256

[56] References Cited

U.S. PATENT DOCUMENTS

| | | | |
|---|---|---|---|
| 2,942,547 | 6/1960 | Rabern et al. | 60/256 |
| 3,332,353 | 7/1967 | Burkardt et al. | 60/256 |
| 3,667,396 | 6/1972 | Barrett | 60/256 |
| 3,715,984 | 2/1973 | Murray | 60/256 |
| 3,729,935 | 5/1973 | Fletcher et al. | 60/256 |
| 4,019,933 | 4/1977 | Cucksee et al. | 149/19.9 |
| 4,057,441 | 11/1977 | Biddle | 149/19.9 |
| 4,090,893 | 5/1978 | Cucksee et al. | 149/19.9 |
| 4,498,292 | 2/1985 | White | 60/256 |

*Primary Examiner*—Edward A. Miller

*Attorney, Agent, or Firm*—Richard J. Sheridan; Gerald K. White

[57] ABSTRACT

Improved igniter compositions for rocket motors are provided which, when cured, are non-volatile and are capable of igniting under vacuum conditions and burning steadily at reduced pressures. Said igniter compositions comprise:

(a) about 11% to about 13% hydroxyl terminated polybutadiene binder prepolymer;

(b) about 0.7% to about 2.0% polyfunctional isocyanate curing agent for said binder prepolymer;

(c) about 2.0% to about 20% metallic powder fuel;

(d) about 20% to about 40% large particle size ammonium perchlorate;

(e) about 30% to about 50% small particle size ammonium perchlorate;

(f) about 0.05% to about 5.0% non-volatile burning rate catalyst;

(g) about 0.05% to about 0.50% bonding agent capable of wetting the solids in the composition by said binder prepolymer and of chemically coupling with said ammonium perchlorate; and (h) about 0.01% to about 0.20% ammonia scavenger wherein all percentages are by weight based on the total weight of the compositions.

8 Claims, 1 Drawing Figure

COMPARISON OF IGNITER PROPELLANT STRESS AND STRAIN MECHANICAL PROPERTIES
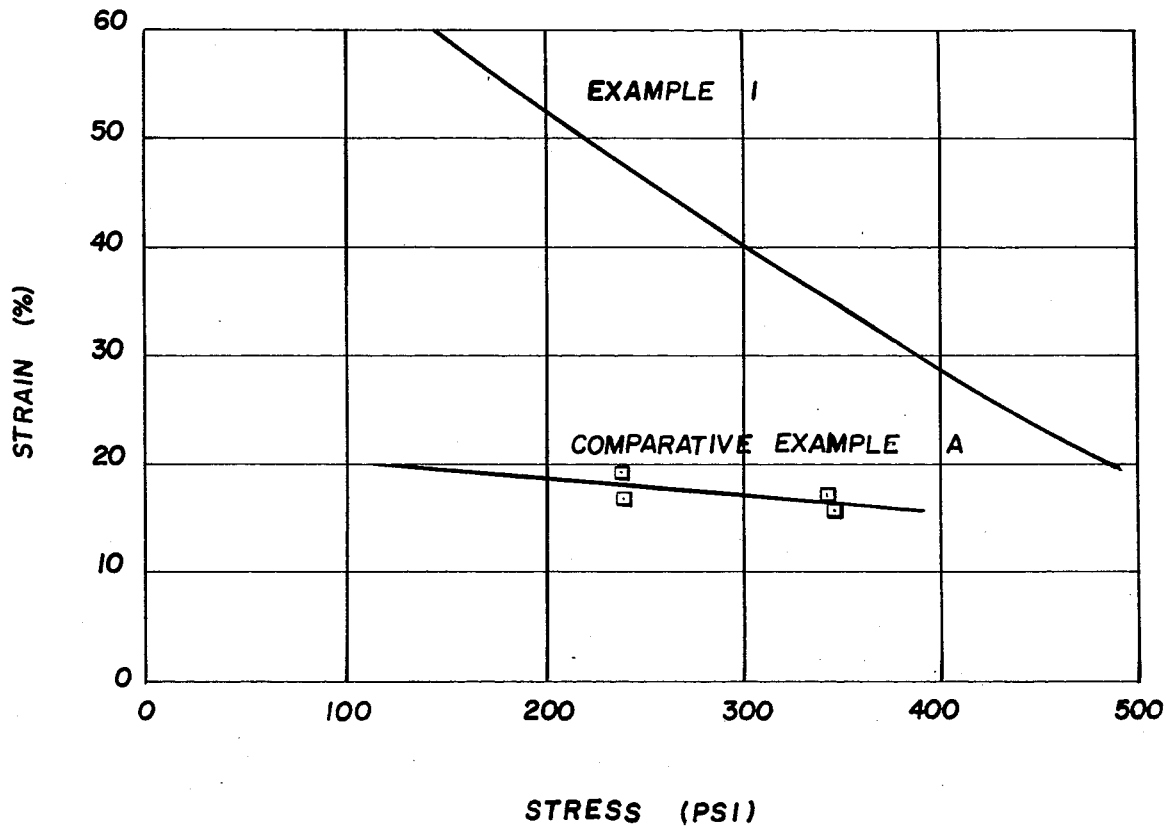

IGNITING ROCKET PROPELLANTS UNDER VACUUM CONDITIONS

The United States Government has rights in this invention pursuant to Contract No. FO4611-80-C-0031 awarded by the U.S. Air Force.

This is a continuation of copending application Ser. No. 569,543 filed on Jan. 10, 1984 which is in turn a continuation of application Ser. No. 463,355 filed on Feb. 2, 1983 both now abandoned.

BACKGROUND OF THE INVENTION

1. Field of the Invention

The present invention relates to an improved igniter propellant composition that ignites and burns at the low pressures of space vacuum to provide hot combustion gases for reliably igniting a rocket motor.

2. Description of the Prior Art

Prior art propellant compositions that meet the requirements of ease of ignition under vacuum conditions in space and which burn steadily at reduced pressures up to two or three pounds per square inch absolute (psia) either use liquid burning rate catalysts or plasticizers. Such liquid catalysts or liquid plasticizers are used in order to obtain a sufficiently high solids level of finely ground ammonium perchlorate to provide processable propellants of sufficient energy to act as energetic igniter compositions.

A problem with such prior art propellants is that the liquid portions thereof are too volatile for the high vacuum conditions found in space in consequence of which liquids diffusing from the propellant can result in changes in the rocket motor burning characteristics. Any volatile materials can also migrate to other assemblies or space experiments that may be stored in the vicinity causing contamination problems.

SUMMARY OF THE INVENTION

An object of the invention is to provide an improved igniter composition for rocket motors containing non-volatile materials which cannot migrate from the igniter matrix and which meets the requirements of ease of ignition under vacuum conditions in space and burns steadily at reduced pressures up to about 2 or 3 psia.

Another object of the invention is to provide such an igniter composition that is characterized in its uncured state by low end-of-mix viscosity resulting in improved castability and cast configurations, and in its cured state by an increased burning rate at low pressures of about 2 or 3 psia with the same burning rate at about 200 psia as that obtained from conventional compositions, and significantly improved stress and strain mechanical properties especially in a desired stress range of about 100 to about 200 psi stress.

A further object of the invention is to provide such an improved composition for use as the propellant in igniters for solid fuel rocket motors, and more particularly, high performance solid fuel rocket motors having full, head-end propellant webs.

In accomplishing these and other objectives, there are provided, according to the present invention, improved igniter compositions containing a hydroxyl terminated polybutadiene binder pre-polymer cured with a polyfunctional isocyanate curing agent, a metallic powder fuel, ammonium perchlorate oxidizer, a non-volatile burning rate catalyst, a bonding agent for the solids and an ammonia scavenger. The compositions of the present invention contain no plasticizers. In the uncured state, the igniter compositions have low end-of-mix viscosity, and in the cured state provide readily ignitable materials which burn steadily at reduced pressures of less than about 3 psia.

BRIEF DESCRIPTION OF THE DRAWINGS

The single figure of drawing is a graphical representation comparing the stress and strain mechanical properties of the igniter composition of the present invention to another igniter composition that was found next best in meeting operational requirements but did not meet the non-volatile requirements.

DESCRIPTION OF THE PREFERRED EMBODIMENT

The igniter compositions of this invention comprise a hydroxyl terminated polybutadiene binder pre-polymer, a polyfunctional isocyanate curing agent, a metallic powder fuel, ammonium perchlorate oxidizer, a non-volatile burning rate catalyst, a bonding agent and an ammonia scavenger. While the particular materials used in the igniter compositions of this invention may vary, they are selected to interact chemically, forming a non-volatile matrix when cured. Thus, for example, the polyfunctional isocyanate curing agent reacts with the hydroxyl terminated polybutadiene, any excess hydroxyl terminated polybutadiene reacts with any excess ammonia scavenger, and the bonding agent reacts with part of the polyfunctional isocyanate curing agent and the ammonium perchlorate. This results in the chemical coupling of any potentially volatile materials into a crosslinked polymer of high molecular weight which is further attached to the solid ammonium perchlorate particles.

The hydroxyl terminated polybutadiene (HTPB) binder pre-polymer may be any HTPB conventionally employed in solid propellants. The preferred HTPB is sold by Arco Chemical Company under the designation R45M. For optimum processability the molecular weight of the pre-polymer ranges from 2800 to 3200, having a viscosity of approximately 64 poise. The functionality of the pre-polymer is about 2.2 to 2.5 hydroxyl groups per polymeric chain to give adequate crosslinking with difunctional isocyanate curatives.

The polyfunctional isocyanate curing agent for the HTPB binder pre-polymer is selected from DDI (a diisocyanate derived from dimerized unsaturated fatty acids, made by G. M. Chemical, Inc.), hexamethylene diisocyanate (HMDI), Desmodur N-100 (an oligomer of HMDI), PAPI (a poly phenylmethylene isocyanate), and isophorone diisocyanate. The preferred polyfunctional isocyanate is isophorone diisocyanate.

The metallic powder fuel may be powdered aluminum or boron, preferably aluminum. In general, the particle size of the metallic powder may range from about 3 to about 100 microns, preferably from about 10 to about 30 microns.

The oxidizer employed in the igniter compositions of this invention is ammonium perchlorate (AP). The AP should be present in both large and small particle sizes; the large particle AP attracts the bonding agent for chemical coupling and the small particle size AP provides a high surface area which sustains combustion at the low presures under which the igniter must perform. Thus, the particle sizes of the AP will range from about 70 to about 400 microns (preferably from about 80 to about 300 microns) for the large particle size AP, and from about 1 to about 60 microns (preferably from about 1 to about 9 microns) for the small particle size AP.

The particular burning rate catalyst employed in the composition of this invention is selected to provide the combined characteristics of non-volatility plus providing the desired burning rate. Thus, a burning rate catalyst such as ferrocene, while perhaps providing a desirable burning rate, is unsuitable due to its volatility. Suitable non-volatile burning rate catalysts include, for example, copper chromite, iron phthalocyanine and iron oxide ($Fe_2O_3$), the preferred non-volatile burning rate catalyst being iron oxide ($Fe_2O_3$).

The bonding agent employed in the igniter compositions of this invention provides improved wetting of the solids in the composition by the HTPB binder prepolymer and by the polyfunctional isocyanate curing agent. Examples of such bonding agents include, but are not limited to, isophthalyl (bis-2,2'-methyl) aziridine (HX752 manufactured by 3M), and an adduct of acrylonitrile and glycidol (sold under the trademark Tepanol by the 3M Company), the latter being preferred. The bonding agent must also be capable of chemically coupling with the AP. For example, the preferred bonding agent (the adduct of acrylonitrile and glycidol) contains basic nitrogen atoms which are attracted to the surface of the AP and is chemically coupled with the AP through amine-perchlorate ionic type of chemical bonds, and hydroxyl groups which react with the isocyanate curing agent thereby producing a linkage between the binder and the AP particles which improves mechanical properties.

The igniter compositions of this invention further contain an ammonia scavenger. This ammonia scavenger is necessary since, when the other components of the compositions are mixed, ammonia may be released as a reaction by-product. For example, ammonia is released when Tepanol and the AP interact. The ammonia thus produced allows hydrogen bonding to occur between the hydroxyl terminated polybutadiene and AP, which results in a severe and undesirable increase in the viscosity of the composition. The ammonia scavenger, however, reacts with the ammonia and prevents it from causing the aforementioned hydrogen bonding. The result is a lowering of the composition viscosity to a workable level. Examples of suitable ammonia scavengers include, but are not limited to, isophorone diisocyanate, DDI, and octadecyl isocyanate (ODI), the ODI being preferred.

The various components of the igniter compositions of this invention may be employed over a range of concentrations as indicated in Table I below where all percentages are by weight based on the total weight of the igniter composition.

TABLE I

| Ingredient | Wt. % Range | Preferred wt % range |
|---|---|---|
| Hydroxyl terminated polybutadiene | 11–13 | 12.6–12.8 |
| Polyfunctional isocyanate curing agent | 0.7–2.0 | 0.8–1.0 |
| Metallic powder fuel | 2.0–20 | 8–15 |
| AP large particle size | 20–40 | 25–35 |
| small particle size | 30–50 | 35–45 |
| Burning rate catalyst | 0.05–5.0 | 1–3 |
| Bonding agent | 0.05–0.50 | 0.1–0.4 |
| Ammonia scavenger | 0.01–0.20 | 0.01–0.1 |

The following example illustrates this invention. Unless otherwise indicated, all parts and percentages in the examples and throughout the specification are by weight.

EXAMPLE 1

An igniter composition according to this invention is prepared from the following formulation:

| Ingredient | Wt %* |
|---|---|
| R-45M hydroxyl terminated polybutadiene | 12.73 |
| Isophorone Diisocyanate (IPDI) | 0.91 |
| octadecyl Isocyanate (ODI) | 0.06 |
| Tepanol | 0.30 |
| Al powder | 10.0 |
| $Fe_2O_3$ | 3.0 |
| AP 200u | 33 |
| 3.2u | 40 |

*based on total composition weight

In preparing the igniter propellant composition, all of the ingredients except the IPDI, ODI and AP are premixed in a bowl that has been pre-heated to a temperature of about 170° F. After such pre-mixing, the procedure in the preparation of the composition is as follows:

1. All of the AP 200 u is added to the bowl and the mixture is mixed at a low speed of 50–60 revolutions per minute (rpm).
2. After fifteen minutes, the unmixed material on the side of the bowl is scraped into the bowl and mixing is started again, this time with an air purge under vacuum for 45 minutes.
3. One-fourth (¼th) of the AP 3.2 u is then added to the mixing bowl and the mixture is mixed for 15 minutes without vacuum. During this mixing cycle, the temperature of the mixing bowl is allowed to drop to 135° F.
4. One-fourth (¼th) of the AP 3.2 u is then added to the bowl and the mixture mixed for 15 minutes.
5. The ODI is then added and the mixture mixed for 15 minutes under vacuum.
6. One-fourth (¼th) of the AP 3.2 u is then added to the mixture and the mixture is mixed during each of successive 15 minute periods until all of the AP 3.2 u has been added.
7. Following this, the material on the side of the bowl is scraped into and merged with the propellant mix.
8. The mixture is then mixed under vacuum with an air purge for about 30 minutes, the mixture being heated during running of the mixer to a temperature of about 140° F.
9. All of the IPDI is then added and the mixture mixed for 20 to 30 minutes with a vacuum, but no air purge, during the final 20 minutes.
10. The propellant mix is then cast into a solid wafer or disc form.

The resulting mixture containing the solids had an end-of-mix (EOM) viscosity of 3.2 kilopoise. The "pot life", that is, the usable casting period was about 7.2 hours.

COMPARATIVE EXAMPLE A

An igniter composition containing the following ingredients is prepared according to the procedure of Example 1 for comparison with the igniter composition of Example 1:

| Ingredient | Wt % |
|---|---|
| R-45M hydroxyl terminated polybutadiene | 10.15 |

-continued

| Ingredient | Wt % |
|---|---|
| Isophorone Diisocyanate | 0.85 |
| Dioctyl adipate (plasticizer) | 3.0 |
| Isophthalyl (bis-2,2'-methyl) aziridine | 0.30 |
| Al powder | 10.0 |
| $Fe_2O_3$ | 3.0 |
| AP 200u | 29 |
| 15u | 44 |

The resulting composition has an end-of-mix viscosity of 7.2 kilopoise, more than twice that of the igniter composition of Example 1, and a "pot life" of about 7.0 hours. Stress and strain mechanical properties of the cured igniter composition of Example 1 and of this example are compared in the Figure.

The igniter propellant composition according to Example 1 showed the following significant improvements over the igniter composition of Comparative Example A: lower end-of-mix viscosity resulting in improved castability and cast configurations, an increased burning rate at low pressures, with the same burning rate at 200 psi as that obtained from the composition of comparative Example A, significantly improved stress and strain mechanical properties especially in the desired stress range of 100 to 200 psi stress, as graphically illustrated in the Figure. Of particular importance, the igniter composition of Example 1 contains non-volatile materials which cannot migrate from the igniter matrix, whereas the composition of Comparative Example A provides a cured igniter composition which contains materials which are volatile at low pressure and can migrate from the igniter matrix. Thus, the igniter compositions according to this invention eliminate the possibility of cross-contamination of other equipment stored in the same vicinity under the conditions found in space and provide an igniter composition with a demonstrated reliable ignition under vacuum conditions.

While the igniter propellant compositions of the present invention may be employed as the igniter charge for conventional solid fuel rocket motors and for other purposes, they are most advantageously employed in igniters for high performance solid fuel rocket motors having full, head-end propellant webs as described in the copending application of C. Max White filed on even date herewith and assigned to the same assignee.

Igniters for such high performance rocket motors must be mounted on the aft portion of the rocket motor propellant, itself, thereby to provide the ignition source of heat as close as possible to the surface to be ignited. Consequently, upon ignition of and burning of the rocket motor propellant, the support for the igniter is eroded. This causes the igniter to become detached from the propellant and presents a problem of possible resultant damage to the rocket motor nozzle or the propellant. In order to avoid such damage, the igniter must be substantially consumed before becoming detached from the propellant. The igniter, additionally, must perform its intended function of igniting the rocket motor propellant before it is consumed.

The igniter of the aforementioned White application is consumable, wafer-like in appearance, and includes a hat-shaped urethane housing. The housing comprises a flat disc attached to one end of a short cylinder, a flange being attached to the other end for attachment of the igniter directly to the rocket motor propellant. A wafer or disc of solid propellant having a composition according to the present invention is attached to the inside of the housing. This disc of solid propellant has holes formed therein and has radial grooves in the surface facing the rocket motor propellant for directing gases from the burning propellant through holes that are provided in the peripheral surface of the cylinder. A liner on the inside surface of the cylinder has holes that are in alignment with the holes in the cylinder but which, normally, are smaller. An igniter initiator having a tubular urethane housing is positioned adjacent the solid propellant disc. Upon ignition of the solid propellant disc, as the internal pressure within the igniter becomes greater, the holes in the liner expand, releasing the hot gases in smoothly increasing volume thereby to provide rapid and reliable ignition of the rocket motor propellant before the igniter is consumed by combustion or becomes detached from the rocket motor propellant due to erosion of the latter.

Thus, there has been provided according to the present invention an improved composition for use as the propellant in igniters for solid fuel rocket motors, a composition having particular utility for igniting high performance rocket motors having full, head-end propellant webs. The improved compositions are characterized in containing non-volatile materials which cannot migrate from the igniter materials and burn at low pressures of space vacuum to provide hot combustion gases for reliably igniting a rocket motor. The improved compositions are further characterized by lower end-of-mix viscosity enabling improved castability and cast configurations, increased burning rate at low pressures of 2 or 3 psia with the same burning rate at 200 psia as that obtained from conventional compositions, and improved stress and strain mechanical properties in a desired stress range of 100 to 200 psi stress.

What I claim and desire to protect by letters patent is:

1. In a method of igniting rocket motors under vacuum conditions, the improvement comprising employing as the igniter a composition which when cured is non-volatile and capable of igniting under vacuum conditions and burning steadily at reduced pressures, said igniter composition comprising:

(a) about 11% to about 13% hydroxyl terminated polybutadiene binder prepolymer;
(b) about 0.7% to about 2.0% polyfunctional isocyanate curing agent for said binder prepolymer;
(c) about 2.0% to about 20% metallic powder fuel;
(d) about 20% to about 40% large particle size ammonium perchlorate;
(e) about 30% to about 50% small particle size ammonium perchlorate;
(f) about 0.05% to about 5.0% non-volatile burning rate catalyst;
(g) about 0.05% to about 0.50% bonding agent capable of wetting the solids in the composition by said binder prepolymer and of chemically coupling with said ammonium perchlorate; and
(h) about 0.01% to about 0.20% ammonia scavenger wherein all percentages are by weight based on the total weight of the compositions.

2. The method of claim 1 wherein the polyfunctional isocyanate curing agent is selected from the group consisting of DDI, hexamethylene diisocyanate, oligomers of hexamethylene diisocyanate, polyphenylmethylene isocyanates, and isophorone diisocyanate.

3. The method of claim 1 wherein the metallic powder fuel is aluminum powder.

4. The method of claim 1 wherein the large particle size ammonium perchlorate is from about 70 to about 400 microns.

5. The method of claim 1 wherein the small particle size ammonium perchlorate is from about 1 to about 60 microns.

6. The method of claim 1 wherein the non-volatile burning rate catalyst is selected from the group consisting of copper chromite, iron phthalocyanine and $Fe_2O_3$.

7. The method of claim 1 wherein the bonding agent is selected from adducts of acrylonitrile and glycidol, and aziridine compounds.

8. The method of claim 1 wherein the ammonia scavenger is selected from the group consisting of isophorone diisocyanate, DDI and octadecyl isocyanate.

* * * * *